United States Patent [19]

Colodney et al.

[11] Patent Number: 4,597,887

[45] Date of Patent: Jul. 1, 1986

[54] GERMICIDAL HARD SURFACE CLEANING COMPOSITION

[75] Inventors: Daniel Colodney, Somerset; Divaker B. Kenkare, South Plainfield, both of N.J.

[73] Assignee: Colgate-Palmolive Company, New York, N.Y.

[21] Appl. No.: 684,557

[22] Filed: Dec. 21, 1984

[51] Int. Cl.[4] ..... C11D 1/62

[52] U.S. Cl. ..... 252/106; 252/153; 252/173; 252/174.14; 252/174.21; 252/DIG. 14; 134/2; 134/40

[58] Field of Search ..... 252/106, 547, 153, 173, 252/174.14, 174.21, DIG. 14; 134/2, 40

[56] References Cited

U.S. PATENT DOCUMENTS

| | | | |
|---|---|---|---|
| 3,247,119 | 4/1966 | Herrick et al. | 252/106 |
| 3,965,026 | 6/1976 | Lancz | 252/547 |
| 4,310,714 | 1/1982 | Pavlin | 585/275 |
| 4,414,128 | 11/1983 | Goffinet | 252/106 |

OTHER PUBLICATIONS

Hydrogenation of α-pinene to pinane, Inst. Chem. Przem., Warsaw, Pol. Krasuska, Przem. Chem. 1981, Chemical Abstract 95:81236t.

*Primary Examiner*—Paul Lieberman
*Assistant Examiner*—Hoa Van Le
*Attorney, Agent, or Firm*—Richard N. Miller; Murray M. Grill; Herbert S. Sylvester

[57] ABSTRACT

An improved germicidal hard surface cleaning composition containing a quaternary ammonium germicide, detergent, builder salts and a binary solvent system comprising a saturated terpene hydrocarbon and a non-aqueous polar solvent is described. The binary system provides improved cleaning action for removal of greasy soil from porous and non-porous hard surfaces and does not interfere with the germicidal activity of the quaternary ammonium salt.

13 Claims, No Drawings

GERMICIDAL HARD SURFACE CLEANING COMPOSITION

BACKGROUND OF THE INVENTION

The use of modern, easy-to-clean, prefabricated kitchen, bathroom, and cellar furnishings, furniture with plastic veneer, and the increasing use of freezer chests, refrigerators, washers and dishwashers, that is, household appliances with enameled metal walls with large surfaces, have led to a steep increase in the demand for all-purpose liquid cleaners in the household having germicidal properties.

General purpose or all-purpose household cleaning compositions for hard surfaces such as metal, glass, ceramic, plastic, and linoleum surfaces have been sold commercially in both powdered and liquid form. The powdered compositions consist mainly of builders and buffering salts such as phosphates, carbonates, silicates, and the like and these compositions are diluted with water prior to use. While use concentrations of such compositions usually provide good inorganic soil removal, they tend to be deficient in removal of organic soils such as the greasy/fatty/oily soils typically found in the domestic environment. Further, such compositions tend not to be compatible with germicidal ingredients because of the presence of anionic detergents and high concentrations of builder salts.

On the other hand, all-purpose liquid cleaners have met with greater commercial acceptance because they have the advantage that they can be applied to hard surfaces in neat or concentrated form so that a relatively high level of surfactant material is delivered directly to the soils. Furthermore, it is easier to incorporate high concentrations of anionic or nonionic surfactant in a liquid rather than in a powdered composition. Because of these two significant advantages, much research and development effort has been expended on formulating all-purpose liquid cleaning compositions which are stable upon storage, have good physical properties and are effective in removing inorganic and organic soils.

Liquid hard surface cleaners generally have been classified into two types. The first type is a particulate aqueous suspension having water-insoluble abrasive particles suspended therein, which particles are palpable. Some of the cleaners of this type suffer a stability problem and other cleaners of this type have received poor acceptance by consumers because of their "gritty" feel which causes many people to be reluctant to use them for fear of scratching the surface to be cleaned. The second type is the liquid detergent without suspended abrasive and, seemingly, this latter type is preferred by consumers. While this second type generally is a mixture of surfactant and builder salt in an aqueous medium, the product formulations in the market place have varied widely in composition.

One liquid product which achieved some success was based upon a mixture of soap, alkylbenzene sulfonate and fatty acid alkanolamide plus inorganic builder salts. Such liquid exhibited good temperature stability and a desirable viscosity, but tended to exhibit cleaning disadvantages as compared with another product based upon a mixture of alkylbenzene sulfonate and ethoxylated alkanol plus builder salts. However, the latter composition usually requires a high concentration of a lower alkylbenzene sulfonate hydrotrope in order to achieve homogeneity in the presence of builder salts and the inclusion of hydrotrope resulted in lower viscosity and the need for thickening agents.

Other all-purpose liquid products were prepared which incorporated a solvent, such as a terpene. For example, German patent application No. 21 13 732 discloses the use of terpenes as anti-microbial agents in washing compositions. British Pat. No. 1,308,190 teaches the use of dipentenes in a thixotropic liquid detergent suspension based composition. German patent application No. 27 09 690 teaches the use of pine oil, a mixture of largely terpene alcohols, in liquid hard surface cleaning compositions. U.S. Pat. No. 4,414,128 teaches the use of terpenes with solvents of limited water solubility such as benzyl alcohol in all-purpose cleaning compositions. The terpenes are used to provide cleaning as well as to control sudsing. A similar composition is disclosed in European patent application No. 0080749 which comprises surfactant, terpenes, butyl carbitol and builder salts. Again, the terpenes are included for cleaning and as suds regulators.

Despite the extensive efforts in formulating all-purpose liquid cleaning compositions, there is still a need for a liquid product with both effective cleaning properties, particularly in removal of grease and oily soil and disinfecting properties when applied neat as well as at use concentrations of 1.5% by weight in water. Also, such products should be effective at varying water hardness levels, should have desirable foaming characteristics and should leave little or no spots or streaks when rinsed or not. Also, the resultant product should be homogeneous at temperatures from about 5° C. to about 49° C. and should exhibit a desirable viscosity. Furthermore, such a product cannot be achieved by simply adding a germicidal quaternary ammonium compound to one of the liquid products discussed above because the quaternary compounds are rendered ineffective by the proportions of anionic detergent and/or builder salts present in those compositions.

The cleaners of the present invention can be formulated to exhibit desirable characteristics with regard to both physical properties and performance in use. As to physical properties, the compositions may be formulated to be homogeneous, pourable, and free-flowing from the container as manufactured as well as after aging at various temperatures. For example, they may be formulated to exhibit a high degree of stability upon storage at normal room temperature of about 24° C. over a period of many months without any appreciable precipitation or formation of layers. Also, when subjected to elevated temperatures of about 38° C. or cooled to about 5° C., the liquid will remain in homogeneous form. As a result of this homogeneity, even when only very small quantities are dispensed, the components will be present in the correct proportions. Furthermore, the liquid may be packaged in any suitable container such as metal, plastic, or glass bottles, bags, cans or drums.

SUMMARY OF THE INVENTION

The cleaning compositions of the present invention comprise a quaternary ammonium germicide, a binary solvent mixture of cis/trans 2,6,6, trimethylbicyclo (3.1.1)heptane—a saturated terpene hydrocarbon also known as Pinane—and a non-aqueous, polar, organic solvent having a solubility in water at 25° C., which is greater than about 20 percent by weight and controlled proportions of a water-soluble nonionic detergent and water soluble builder salts in an aqueous medium. Such compositions are considered to represent one solution to the the problems discussed above because they are characterized by germicidal effectiveness when used neat or at use dilution concentrations of about 1.5% by weight in water and also exhibit good cleaning effectiveness, particularly on grease soils, under the same conditions of use.

More particularly, the clear, liquid, germicidal, hard surface cleaner consists essentially of, by weight, a water-soluble, germicidal, quaternary ammonium salt having an alkyl group of 8 to 18 carbon atoms in its structure in an amount from the range of 2.5% to 6% which is effective to provide germicidal properties at a concentration of 1.5% by weight of said cleaner in water; 2% to 5% of a water-soluble ethyleneoxylated nonionic detergent; from 1% to 8% of cis/trans 2,6,6 trimethylbicyclo (3.1.1) heptane; from 1% to 8% of a nonaqueous, polar, organic solvent having water solubility at 25° C. of at least 20% by weight selected from the group consisting of $C_1$–$C_4$ alkyl ethers of ethylene glycol or diethylene glycol or mono-, di- or tripropylene glycol, from 2% to 6% of a water-soluble organic or inorganic alkaline builder salt; the weight of said nonionic detergent being not greater than the weight of said quaternary salt; and the balance primarily water.

In a preferred aspect of this invention, the clear, liquid, germicidal, all purpose cleaners contain, by weight, 3% to 4.5% of a quaternary ammonium salt which includes a $C_8$–$C_{18}$ alkyl dimethyl benzyl ammonium salt; the nonionic detergent is a condensate of a $C_8$–$C_{18}$ alkanol with 5 to 30 moles of ethylene oxide; 1.5% to 4% of Pinane; 1.5% to 4% of the nonaqueous, polar, organic solvent; 3% to 5% of said builder salt with the weight ratio of builder salt to quaternary salt being less than 1.25:1; and the balance primarily water. In the most preferred compositions, the amount of nonionic detergent will be less than 90% of the weight of the quaternary salt and, further, such compositions will be free of anionic detergent salts and anionic hydrotropic salts.

The liquid cleaners according to the present invention have been found to exhibit effective foaming and removal of soil, particularly, grease soil, from glass, woodwork, vitreous and painted substrates. Additionally, these cleaners are effective in disinfecting the cleaned substrates.

DETAILED DESCRIPTON OF THE INVENTION

The quaternary ammonium compounds which are used in the compositions of this invention must be effective to destroy microorganisms which are gram positive such as Staphylococcus aureus and microorganisms which are gram negative such as Salmonella choleraesuis and Pseudomonas aeruginosa when used either neat—full strength—or at use concentrations of about 1.5% of the all-purpose liquid in water. Generally, the germicidal quaternary compounds contain a $C_8$–$C_{18}$ alkyl group and either a benzyl or ethylbenzyl group in their molecular structure. Usually, these germicidal quaternary disinfectants include a $C_8$–$C_{18}$ alkyl di $C_1$–$C_3$ alkyl benzyl quaternary salt selected from the group consisting of chloride, bromide, sulfate and acetate. Preferably, the quaternary disinfectant also will include a corresponding $C_8$–$C_{18}$ alkyl di $C_1$–$C_3$ alkyl ethylbenzyl quaternary salt, with the weight ratio of benzyl quat to ethylbenzyl quat being about 1:1 in the most preferred cleaners. Suitable germicidal quaternary salts include $C_8$–$C_{18}$ alkyl (coco) dimethyl benzyl ammonium bromide, cetyl trimethyl ammonium chloride, myristyl dimethyl propyl ammonium acetate, lauryl dimethyl ethyl ammonium methosulfate, $C_8$–$C_{18}$ alkyl (coco) dimethyl ethylbenzyl ammonium chloride and $C_8$–$C_{18}$ alkyl (coco) dimethyl ethylbenzyl ammonium bromide.

Nonionic detergents used in the cleaners according to the present invention can be broadly described as water-soluble or water-dispersible compounds produced by the condensation of hydrophilic ethylene oxide groups with an organic hydrophobic aliphatic or alkyl aromatic compound having a terminal hydroxy group. Such detergents are prepared readily by condensing the hydrophobic organic compound with ethylene oxide or with the polyhydration product thereof, polyethylene glycol. Further, the length of the polyethenoxy chain can be adjusted to achieve the desired balance between the hydrophobic and hydrophilic elements.

The satisfactory nonionic detergents include the condensation products of a higher alkanol containing about 8 to 18 carbon atoms in a straight- or branched-chain configuration condensed with about 5 to 30 moles of ethylene oxide. Preferred examples of these detergents are the condensates of $C_9$–$C_{11}$ alkanol with 2.5 moles of ethylene oxide, condensates of $C_{12}$–$C_{13}$ alkanol with 6.5 moles of ethylene oxide and condensates of $C_{10}$–$C_{12}$ alkanol with about 60% by weight of ethylene oxide.

Other satisfactory nonionic detergents are the polyethylene oxide condensates of one mole of alkyl phenol containing from about 6 to 15 carbon atoms in a straight-or branched-chain configuration with about 5 to 30 moles of ethylene oxide, with the ethylene oxide content being from about 40% to about 60% by weight of the condensate.

The saturated terpene hydrocarbon employed in the compositions of the present invention is cis/trans 2,6,6 trimethylbicyclo (3.1.1) heptane which is sold by Glidden as intermediate Pinane. While this compound has good solvent properties, it has limited solubility in water. Thus, preparation of homogeneous compositions using Pinane presents problems for the formulator.

The polar organic solvents employed in the present invention in combination with Pinane have a solubility in water at 25° C. of at least about 20% by weight and thus are water miscible or water soluble. Suitable nonaqueous solvents may be described generally as $C_1$–$C_4$ alkyl ethers of a compound selected from the group consisting of ethylene glycol, diethylene glycol and mono-, di or tripropylene glycol. Specific examples of such nonaqueous, polar, organic solvents include ethylene glycol monomethyl ether, ethylene glycol monobutyl ether, diethylene glycol monoethyl ether, tripropylene glycol mono-methyl ether and dipropylene glycol monomethyl ether, with ethylene glycol monobutyl ether, tripropylene glycol monomethyl ether and dipropylene glycol monomethyl ether being particularly preferred. An essential characteristic of these solvents is their solubility in water because this property is essential to achieve effective solvent action in conjunction with Pinane and at the same time maintain homogeneity.

Another essential component in the compositions of this invention as a water soluble builder salt or mixture of builder salts. Such salts are included to enhance the cleaning action of the organic surface active agents—the nonionic detergents—and to maintain the pH of the all-purpose liquid composition in the alkaline range.

Such salts are water-soluble and may be either organic or inorganic compounds capable of sequestering or precipitating calcium ions. Generally the builder salt will be a water-soluble sodium, potassium or ammonium salt of carbonate, bicarbonate, polyphosphate, polycarboxylate or aminopolycarboxylate. Examples of suitable builder salts include sodium carbonate, sodium bicarbonate, potassium tripolyphosphate, potassium pyrophosphate, sodium citrate dihydrate, trisodium nitrilotriacetate, tetrasodium ethylenediamine tetraacetate and mixtures thereof. A preferred builder is the mixture of sodium citrate dihydrate and sodium carbonate, and sodium bicarbonate.

The final essential component of the inventive compositions is water and this component usually represents the balance of said compositions except for the presence of optional ingredients.

The proportions of the various essential ingredients in the inventive compositions are integrated in order to achieve the desired homogeneity, and performance—disinfecting and cleaning—properties. Generally, the proportion of quaternary ammonium salt employed will be from 2.5% to 6%, preferably from 3% to 4.5%, by weight. However, the proportion of quaternary ammonium salt must be sufficient to provide disinfecting action at use concentrations of 1.5% by weight of the all-purpose liquid cleaner in water. Usually, the proportion of water-soluble nonionic detergent will be from the range of 2% to 5%, but will be controlled relative to the quaternary ammonium salt so that it will be not greater than the weight of said salt. Preferably, the weight ratio of nonionic detergent to quaternary germicide will be less than 0.9, i.e., less than 90% by weight thereof. Generally, the builder salt or mixture thereof will be about 2% to 6%, preferably 3% to 5%, by weight. The proportion of builder salt must be controlled in this range because greater amounts tend to adversely effect the germicidal properties of the quaternary salt and lesser amounts do not achieve satisfactory cleaning action. Additionally, similar to the nonionic detergent, the weight ratio of builder salt to quaternary ammonium salt is maintained below about 1.25:1 in the preferred compositions. Generally, the proportion of the saturated terpene will be from about 1% to 8%, preferably from about 1.5% to 4%, by weight. Similarly, the nonaqueous, polar, organic solvent with the specified water solubility will be from about 1% to 8%, preferably 1.5% to 4%, by weight. Such amounts of saturated terpene and nonaqueous polar organic solvent of the stated water solubility coact with the controlled proportions of nonionic detergent and builder salt to provide the desired foaming and cleaning properties. The balance of the composition will be water in the absence of any optional ingredients. Naturally, the proportion of water will be reduced by the proportion of any optional ingredients which may be present.

Optionally, up to 8% by weight of urea may be included in the all-purpose liquid compositions. When present, urea provides improved low temperature stability by reducing the clear point of the all-purpose liquid. The preferred concentration of urea is 1% to 6% by weight.

Another optional component is ammonia which is usually added as aqueous ammonia or ammonium hydroxide. This ingredient provides a desirable ammonia odor in the product and appears to enhance the removal of grease soil. When present, the concentration of ammonia in the all-purpose liquid usually ranges from about 0.1% to 0.5%, preferably 0.15% to 0.25%, by weight.

The all-purpose liquid according to this invention may, if desired, also contain other components either to provide an additional effect or to make the product more attractive to the consumer. The following are mentioned by way of example. Up to 1% by weight of perfumes, colors or dyes, opacifiers, bactericides and tarnish inhibitors such as benzotriazole may be added. Further, up to about 2% by weight of an organic solvent such as ethanol, ethylene glycol or propylene glycol may be included for control of viscosity or special solvent effects. Additionally, supplemental water-soluble, inorganic salts, preferably non-phosphate salts, such as sodium silicate, sodium sulfate, sodium chloride, etc. may be present in amounts up to about 3% by weight to provide enhanced building action or for pH control.

In final form, the all-purpose liquids are clear and homogeneous and exhibit stability at reduced and increased temperatures. More specifically, such compositions exhibit clear points in the range of 5° C. to 50° C. and generally do not cloud below about 65° C. when heated. Such compositions exhibit a pH in the range of 7.5 to 11.5, preferably 9 to 11. The liquids are readily pourable and exhibit a viscosity in the range of 5 to 60 centipoises (cps.) as measured at 24° C. with a Brookfield RVT Viscometer using a #1 spindle rotating at 20 RPM. Preferably, the viscosity is maintained in the range of 10 to 30 cps.

Typically, the inventive compositions are manufactured in an agitated mixing vessel optionally equipped with a heating and/or cooling jacket. Generally, the temperature of the mixture will be maintained in the range of 15° C. to 38° C. during manufacture. While the order in which the individual ingredients are added can be varied, best results are obtained by adding the nonionic detergent to the water with mild agitation followed by the addition of the quaternary ammonium salt. Next, the Pinane and nonaqueous solvent are added with moderate agitation to form a homogeneous mixture. Thereafter, the builder salt(s), usually in particulate form, are added with moderate agitation which is continued until said salts are dissolved. Usually, color and perfume are the final ingredients added with agitation to form a homogeneous all-purpose liquid cleaning composition.

The following examples illustrate germicidal, liquid, cleaning compositions of the described invention. Unless otherwise specified, all percentages are by weight. The exemplified compositions are illustrative only and do not limit the scope of the invention.

EXAMPLE I

A preferred germicidal, liquid, all-purpose liquid cleaner is prepared having the following composition:

| Ingredient | % by wt. |
|---|---|
| $C_8$–$C_{18}$ alkyl (coco) dimethyl benzyl ammonium chloride[a] | 3.5 |
| $C_{12}$–$C_{13}$ alkanol condensed with 6.5 moles of ethylene oxide | 3.5 |
| Pinane | 1.8 |
| Monomethylether of tripropylene glycol | 1.8 |
| Hydroxyethyl ethylene diamine triacetate | 0.1 |
| Sodium carbonate | 1.5 |
| Sodium bicarbonate | 0.5 |

-continued

| Ingredient | % by wt. |
|---|---|
| Sodium citrate dihydrate | 2.3 |
| Perfume | 1.0 |
| Water | q.s |
| Total | 100.0 |

q.s. - quaniity sufficient
[a]Alkyl distribution is 5% $C_{12}$, 60% $C_{14}$, 30% $C_{16}$ and 5% $C_{18}$.

The foregoing composition is prepared using the same order of addition discussed above wherein the quaternary salt and the nonionic detergent are solubilized in the water prior to the addition of the Pinane and organic solvent. Thereafter, the builder salt and perfume are added. The mixture is agitated moderately during the course of addition of th individual ingredients. The resultant product is a clear, homogeneous liquid having a viscosity of 15–20 cps. at 24° C. Furthermore, such composition is homogeneous when stored at temperatures of 5° C. and 38° C.

When said composition is dissolved in water at a concentration of 1.5%, such composition is effective as a germicide against gram positive and gram negative microorganisms.

EXAMPLE 2

The composition of Example 1 is repeated with the exception that 1.75% by weight of a $C_8$–$C_{18}$ alkyl dimethyl ethylbenzyl ammonium chloride is substituted for 1.75% by weight of said $C_8$–$C_{18}$ alkyl dimethyl benzyl quaternary ammonium chloride. The resultant liquid is homogeneous and exhibits effective cleaning and disinfectant properties when used as full strength or at 1.5% concentration in water.

EXAMPLE 3

The composition of Example 1 is repeated except that the proportion of quaternary ammonium chloride is increased to 4% by weight with a corresponding reduction in the amount of water. A particularly effective disinfectant cleaner is achieved.

The foregoing examples clearly demonstrate that an all-purpose gericidal liquid cleaner can be achieved by careful control and integration of the essential ingredients, particularly the quaternary salt, nonionic detergent and builder salt. Further, it is noted that the preferred compositions do not contain any anionic detergent or anionic hydrotropic salt.

It is understood that the foregoing detailed description is given merely by way of illustration and that variation may be made therein without departing from the spirit of the invention. The "Abstract" given above is merely for the convenience of technical searchers and is not to be given any weight with respect to the scope of the invention.

What is claimed is:

1. A clear, liquid, germicidal, hard surface cleaner consisting essentially of, by weight, a water-soluble, germicidal, quaternary ammonium salt having an alkyl group of 8 to 18 carbon atoms in its structure in an amount from the range of 2.5% to 6% which is effective to provide germicidal properties at a concentration of 1.5% by weight of said cleaner in water; 2% to 5% of a water-soluble ethyleneoxylated nonionic detergent; from 1% to 8% of cis/trans 2,6,6 trimethylbicyclo (3.1.1) heptane; from 1% to 8% of a nonaqueous, polar, organic solvent having water solubility at 25° C. of at least 20% by weight selected from the group consisting of $C_1$–$C_4$ alkyl ethers of ethylene glycol or diethylene glycol or mono-, di- or tripropylene glycol, from 2% to 6% of a water-soluble organic or inorganic alkaline builder salt; the weight of said nonionic detergent being not greater than the weight of said quaternary salt; and the balance primarily water.

2. A cleaner according to claim 1 wherein said quaternary ammonium salt includes an alkyl dimethyl benzyl ammonium salt selected from the group consisting of chloride, bromide and acetate.

3. A cleaner according to claim 2 wherein said quaternary ammonium salt further includes an alkyl dimethyl ethylbenzyl ammonium salt selected from the group consisting of chloride, bromide and acetate.

4. A cleaner according to claim 3 wherein the weight ratio of alkyl dimethyl benzyl ammonium salt to alkyl dimethyl ethylbenzyl ammonium salt is about 1:1

5. A cleaner according to claim 2 wherein said nonaqueous solvent is said $C_1$–$C_4$ alkyl ether of mono-, di- and tri-propylene glycol and said nonionic detergent is a condensate of a $C_8$–$C_{18}$ alkanol with 5 to 30 moles of ethylene oxide.

6. A cleaner according to claim 5 wherein said builder is a mixture of sodium citrate dihydrate, sodium bicarbonate and sodium carbonate.

7. A cleaner according to claim 2 wherein said nonaqueous solvent is ethylene glycol monobutyl ether and said nonionic detergent is a condensate of a $C_8$–$C_{18}$ alkanol with 5 to 30 moles of ethylene oxide.

8. A cleaner according to claim 7 wherein said builder is a mixture of sodium citrate dihydrate, sodium bicarbonate and sodium carbonate.

9. A cleaner according to claim 1 wherein said quaternary ammonium salt includes an alkyl dimethyl benzyl quaternary ammonium salt and is present in an amount of 3% to 4.5% by weight, said nonionic detergent is a condensate of a $C_8$–$C_{18}$ alkanol with 5 to 30 moles of ethylene oxide; said heptane is present in an amount of 1.5% to 4% by weight; said nonaqueous solvent is present in an amount of 1.5% to 4% by weight; and said builder salt is present in an amount of 3% to 5% by weight, with the weight ratio of builder salt to said quaternary salt being less than 1.25:1.

10. A cleaner according to claim 9 wherein said nonaqueous solvent is said $C_1$–$C_4$ alkyl ether of mono-, di- and tri-propylene glycol.

11. A cleaner according to claim 10 wherein said builder is a mixture of sodium citrate dihydrate, sodium bicarbonate and sodium carbonate.

12. A cleaner according to claim 9 wherein said nonaqueous solvent is ethylene glycol monobutyl ether.

13. A cleaner according to claim 12 wherein said builder is a mixture of sodium citrate dihydrate, sodium bicarbonate and sodium carbonate.

* * * * *